US005947521A

United States Patent [19]

Stucki

[11] Patent Number: 5,947,521

[45] Date of Patent: Sep. 7, 1999

[54] BINDER SPACER

[76] Inventor: Ronald Stucki, 1113 S. 700 East, Salt Lake City, Utah 84105

[21] Appl. No.: 09/110,325

[22] Filed: Jul. 6, 1998

Related U.S. Application Data

[60] Provisional application No. 60/057,421, Sep. 3, 1997.

[51] Int. Cl.[6] ..... B42D 9/00

[52] U.S. Cl. ..... 281/20

[58] Field of Search ..... 281/20

[56] References Cited

U.S. PATENT DOCUMENTS

| | | |
|---|---|---|
| 281,466 | 7/1883 | Davis . |
| 501,751 | 7/1893 | Waring . |
| 1,674,265 | 6/1928 | Roeger . |
| 3,936,202 | 2/1976 | Brajituli . |
| 4,531,764 | 7/1985 | Chang . |
| 5,002,416 | 3/1991 | Serzen . |
| 5,267,804 | 12/1993 | Baumgarten . |
| 5,380,111 | 1/1995 | Westrom . |
| 5,398,971 | 3/1995 | Ayele . |
| 5,590,909 | 1/1997 | Urbana et al. . |
| 5,634,666 | 6/1997 | Lee ..... 281/20 |

FOREIGN PATENT DOCUMENTS

| | | |
|---|---|---|
| 1171561 | 1/1957 | France . |
| 1322937 | 2/1962 | France . |
| 2116481 | 9/1983 | United Kingdom . |

*Primary Examiner*—Willmon Fridie, Jr.
*Assistant Examiner*—Mark T. Henderson
*Attorney, Agent, or Firm*—Richard C Litman

[57] ABSTRACT

A binder spacer for use with a looseleaf notebook. The binder spacer is removably attached to one of the covers of a notebook by a clip. Spacing members depending generally perpendicularly from the clip keep the covers in a substantially parallel orientation. The spacing members are sized to match the space between the covers which necessarily approximate the width of the notebook's spine. Because looseleaf notebooks come in different sizes, the binder spacer comes in different sizes to accommodate for the varying notebook sizes.

5 Claims, 13 Drawing Sheets

BINDER SPACER

ROSS-REFERENCE TO RELATED APPLICATION

This application claims the benefit of U.S. Provisional Patent Application Ser. No. 60/057,421, filed Sep. 3, 1997.

BACKGROUND OF THE INVENTION

1. Field of the invention

The present invention relates to a notebook binder spacer, in particular, a looseleaf notebook binder spacer which removably attaches to an outer cover of the notebook, and keeps the outer covers evenly spaced in accordance with the width of the notebook's spine.

2. Description of Related Art

Looseleaf notebook binders are a common staple for household and office use. The average person usually has a plurality of different sized notebooks. The problem with most looseleaf notebooks is their inconvenient configuration for storage. As is often the case, the user has an insufficient amount of paper inserted in the looseleaf notebook in order to place the covers in a substantially parallel orientation. As such, stacking the notebooks or placing them on a bookshelf is cumbersome.

The prior art is replete with notebooks that have means for spacing the covers of a looseleaf notebook. Most prior art binder spacers are integral with the looseleaf notebook; However, U.S. Pat. No. 4,531,764, issued Jul. 30, 1985 to Kwei K. Chang shows an adjustable binder spacer which attaches to the inside cover of a looseleaf binder. The '764 device attaches to the inside cover by means of hook and loop material, ball and socket, or other rapid fastening members. The spacer is an inverted V-portion which is adjustable between different spacing positions.

U.S. Pat. No. 5,002,416, issued Mar. 26, 1991 to Russell D. Serzen and U.S. Pat. No. 5,380,111, issued Jan. 10, 1995 to S. John Westrom shows binder spacers with a longitudinal spacer member perpendicularly attached to an inside cover of a looseleaf binder.

U.S. Pat. No. 5,634,666, issued Jun. 3, 1997 to Dong H. Lee shows a binder with a cover spacer which restrains the covers of a binder. The spacer comprises a first base portion affixed to one of the covers, a stand-off element hingedly attached to the first base portion, and a second base portion affixed to the opposite cover, the second base portion having a clasp or catch arrangement which holds the distal end of the stand-off element.

Whereas the '416, '111, and '666 devices solve the problem of keeping the covers of a looseleaf binder in a substantially parallel orientation, they suffer from the disadvantage of being fixedly attached to the binder. They cannot be used with standard binders that most users invariably have.

Other less relevant patents and applications include: U.S. Pat. No. 281,466, issued Jul. 17, 1883 to Charles A. Davis (untitled "Paper File"); U.S. Pat. No. 501,751, issued Jul. 18, 1893 to Thomas Waring (Paper File); U.S. Pat. No. 1,674,265, issued Jun. 19, 1928 to Fred Roeger (Memorandum-Pad Device); U.S. Pat. No. 3,936,202, issued Feb. 3, 1976 to Peter Brajituli (Ring Binder); U.S. Pat. No. 5,267,804, issued Dec. 7, 1993 to Hans J. Baumgarten (Apparatus And Method For Making A Binder Self-Supporting); U.S. Pat. No. 5,398,971, issued Mar. 21, 1995 to Fikre Ayele (File Cover Restraining System); U.S. Pat. No. 5,590,909, issued Jan. 7, 1997 to Joseph Urban, Richard Roig, and Fikre Ayele (File Cover Restraining System); French Pat. No. 1,171,561, published Jan. 28, 1959 and applied by Daniel Valla; French Pat. No. 1,322,937 applied by Anciens Etablissements Technica S.A.; and U.K. Pat. App. 2,116,481, published Sep. 28, 1983 and applied for by Victor Blunt (Clamping Bar For Paper File).

None of the above inventions and patents, taken either singly or in combination, is seen to describe the instant invention as claimed.

SUMMARY OF THE INVENTION

The present invention is a binder spacer which comprises a clipping means and a spacing means attached substantially perpendicular to the clipping means. The binder spacer is for use with a looseleaf notebook having a pair of covers swingably attached to a spine.

The binder spacer is removably attached to one of the covers by a clipping means. The clipping means operates similarly to a paper clip. Spacing members depending generally perpendicularly from the clipping means keep the covers in a substantially parallel orientation. The spacing members are sized to match the space between the covers which necessarily approximate the width of the notebook's spine. Given the fact that looseleaf notebooks come in different sizes, the binder spacer comes in different sizes to accommodate for the varying notebook sizes.

Accordingly, it is a principal object of the invention to provide an apparatus that keeps the covers of a looseleaf binder in a substantially parallel orientation.

It is another object of the invention to provide an apparatus to evenly space binder covers that is easily adaptable to existing looseleaf binders.

It is a further object of the invention to provide an apparatus that orient binder covers in a substantially parallel position while holding looseleaf papers against one of the covers.

Still another object of the invention is to provide a binder spacer which is adaptable to multiple uses.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

FIGS. 7A, 7B and 7C are perspective views of an alternative, second embodiment of the binder spacer in various states, wherein FIG. 7A is an exploded view of the binder spacer shown in FIG. 7B, and FIG. 7C shows the binder spacer in a collapsed state.

Similar reference characters denote corresponding features consistently throughout the attached drawings.

DETAILED DESCRIPTION OF THE EMBODIMENTS

Figure 3:
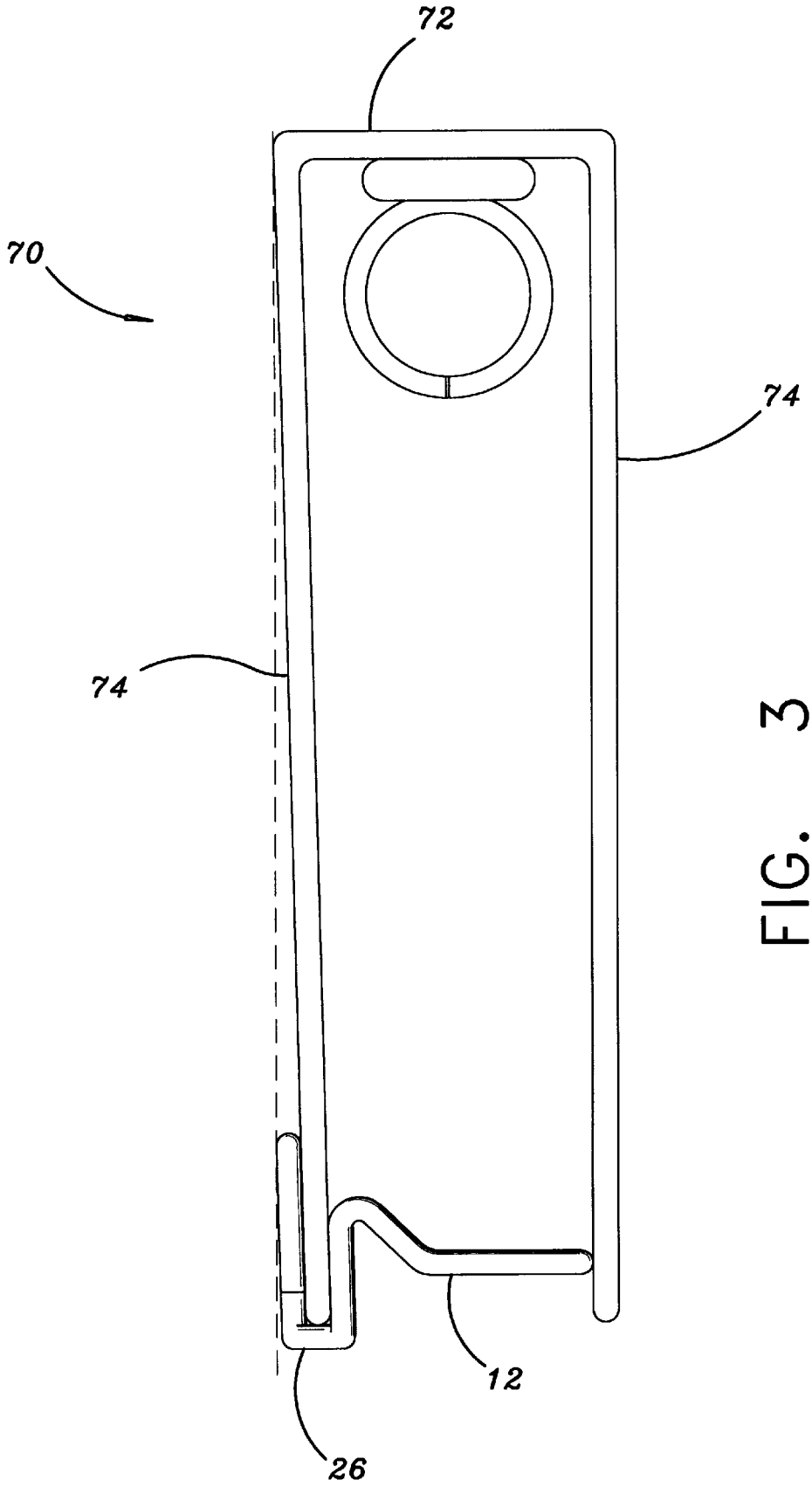
FIG. 3 is an environmental side view of the binder spacer clipped to a cover of a looseleaf notebook and spacing the opposite cover in a substantially parallel orientation.
Figure 4:
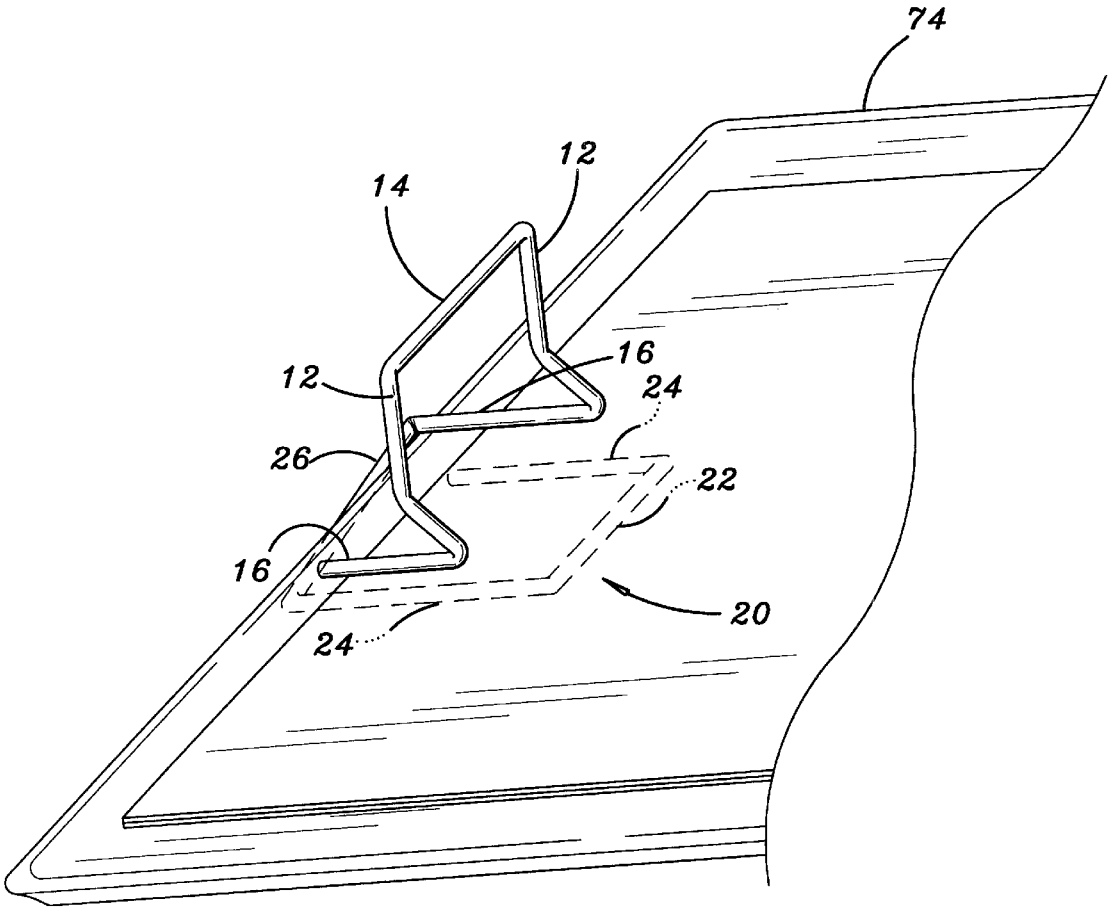
FIG. 4 is an environmental perspective front view of the binder spacer clipped to a cover of a looseleaf notebook and holding down a plurality of looseleaf papers.
Figure 5:
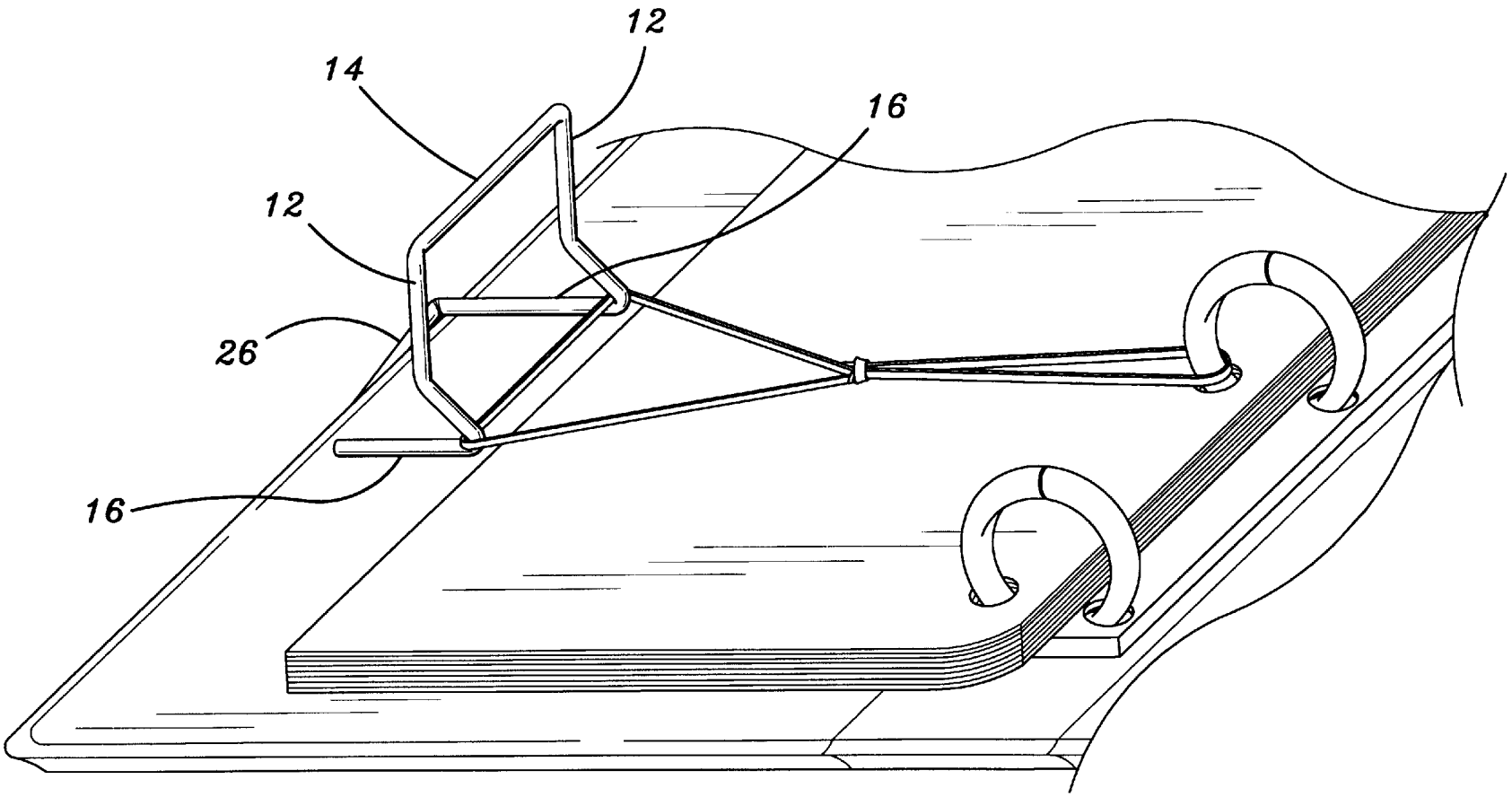
FIG. 5 is an environmental perspective side view of the binder spacer clipped to a cover of a looseleaf notebook in combination with an elastic band to hold down a plurality of looseleaf papers.
Figure 6:
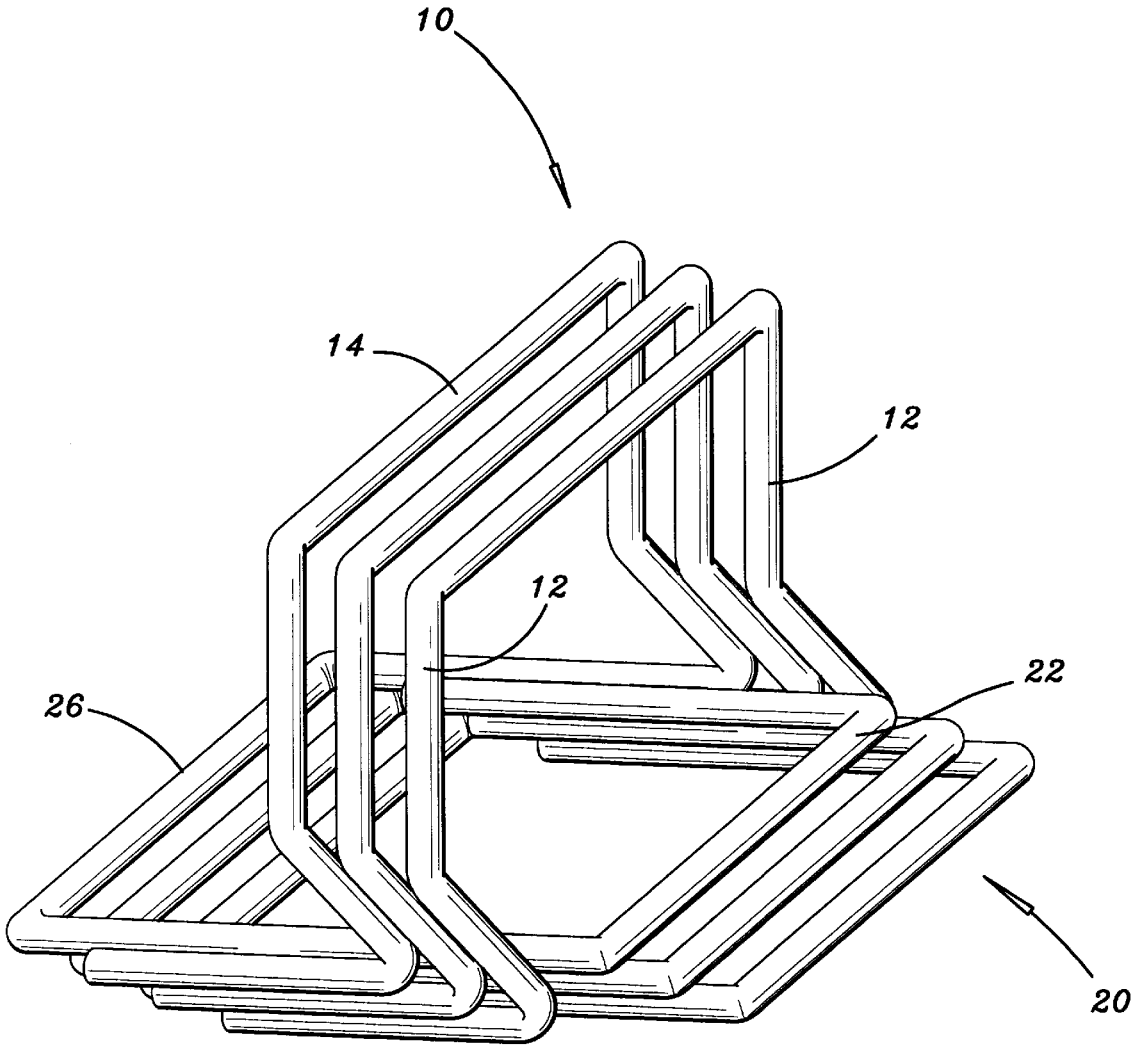
FIG. 6 is a perspective front view of a plurality of binder spacers in storage.

The present invention is a binder spacer 10 for use with a looseleaf notebook 70, shown in FIG. 3. The notebook 70 has a spine 72, which is essentially a rectangular member having a length and a width, and a pair of covers 74 swingably attached to the spine 72 along each of longitudinal edges. When the looseleaf notebook 70 is empty, the covers 74 converge on each other at their respective distal edges. Even when looseleaf papers are inserted in the looseleaf notebook 70, the amount of papers inserted are usually insufficient to orient the covers 74 in a substantially parallel orientation. This makes it difficult to store a plurality of looseleaf notebooks 70 having covers 74 of non-parallel orientation in a cover-to-cover array.

The binder spacer 10 solves the problem of storing a plurality of looseleaf notebooks 70 having covers 74 in a non-parallel orientation. The binder spacer 10 comprises a clipping means and a spacing means connected substantially perpendicular to the clip. The binder spacer 10 is preferably made of a pliable material, such as certain metals or plastics.

FIGS. 1–6 show one embodiment of the binder spacer 10. The clipping means and spacing means of the binder spacer 10 are preferably of unitary construction. The spacing means comprises a pair of opposing legs 12 and a span 14 fixedly attached to an end of each of the legs 12.

The clipping means has a pair of opposing feet 16 fixedly attached to the ends of the legs 12 opposite the span 14. The clipping means also has a tongue 20 comprising a leading edge member 22 and a pair of side members 24, each of the side members 24 lying substantially flush with each of the feet 16. One end of rear longitudinal member 26 is attached to the end of one foot 16 and the opposite end of longitudinal member 26 is attached to one of the side members 24 of the tongue 20.

FIGS. 2–6 shows the binder spacer 10 in use with a looseleaf notebook 70. A user of the binder spacer 10 places the leading edge member 22 next to the distal edge of a cover 74 and slides the leading edge member 22 along the exterior surface of the cover 74. When the distal edge of the cover 74 contacts the connection point of the legs 12 and feet 16, the user directs the feet 16 to slide along the interior surface of the cover 74. Thus, the tongue 20 of the clipping means is substantially flush against the exterior surface of the cover 74 while the feet 16 of the clipping means is substantially flush against the interior surface of the cover 74. The rear longitudinal member 26 keeps the tongue 20 and feet 16 substantially flush against cover 74 surfaces.

Once the binder spacer 10 is properly clipped in place, the user may close the opposing cover 74 to rest against the span 14 of the spacing means. The spacing means preferably comes in different sizes to accommodate for the varying spine 72 widths of a looseleaf notebook 70. Thus, when the covers 74 are closed, the covers 74 are in a substantially parallel orientation; making a plurality of looseleaf notebooks 70 easily storable.

Figure 7B:
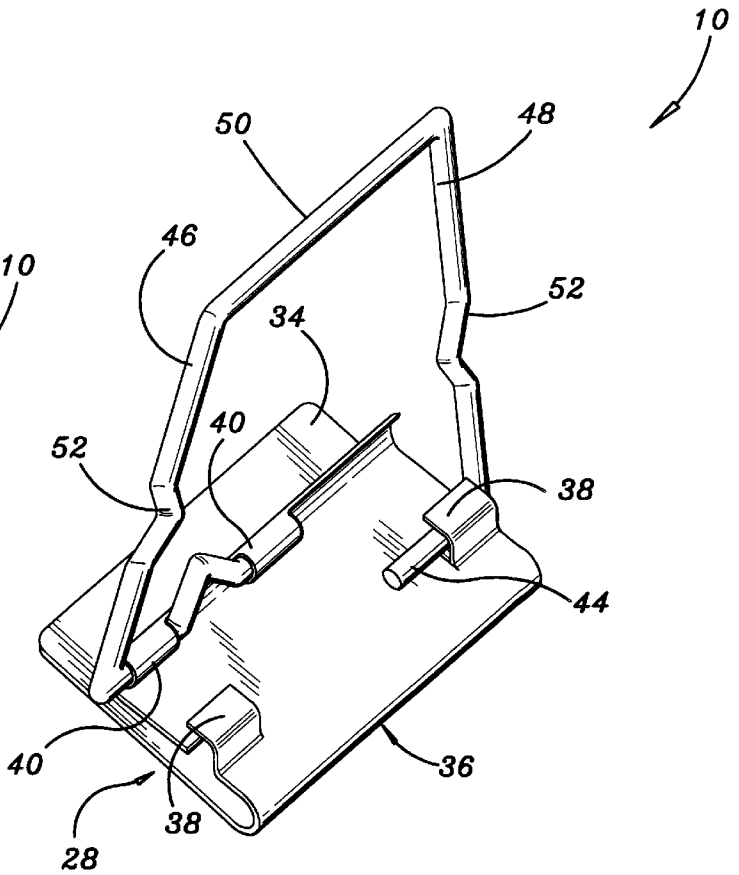
Figure 7A:
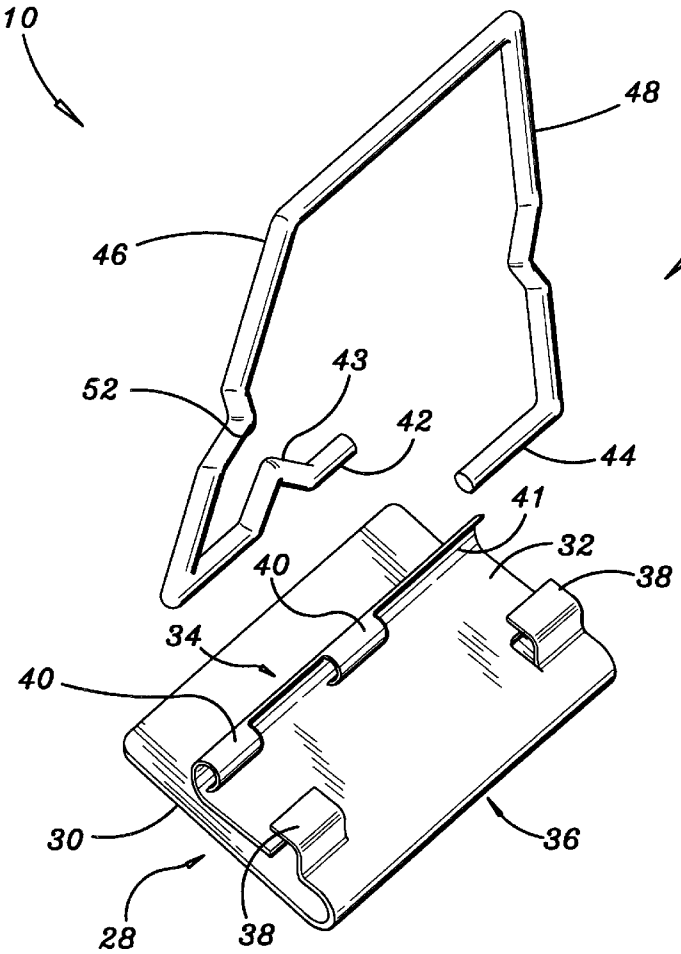
Figure 7C:
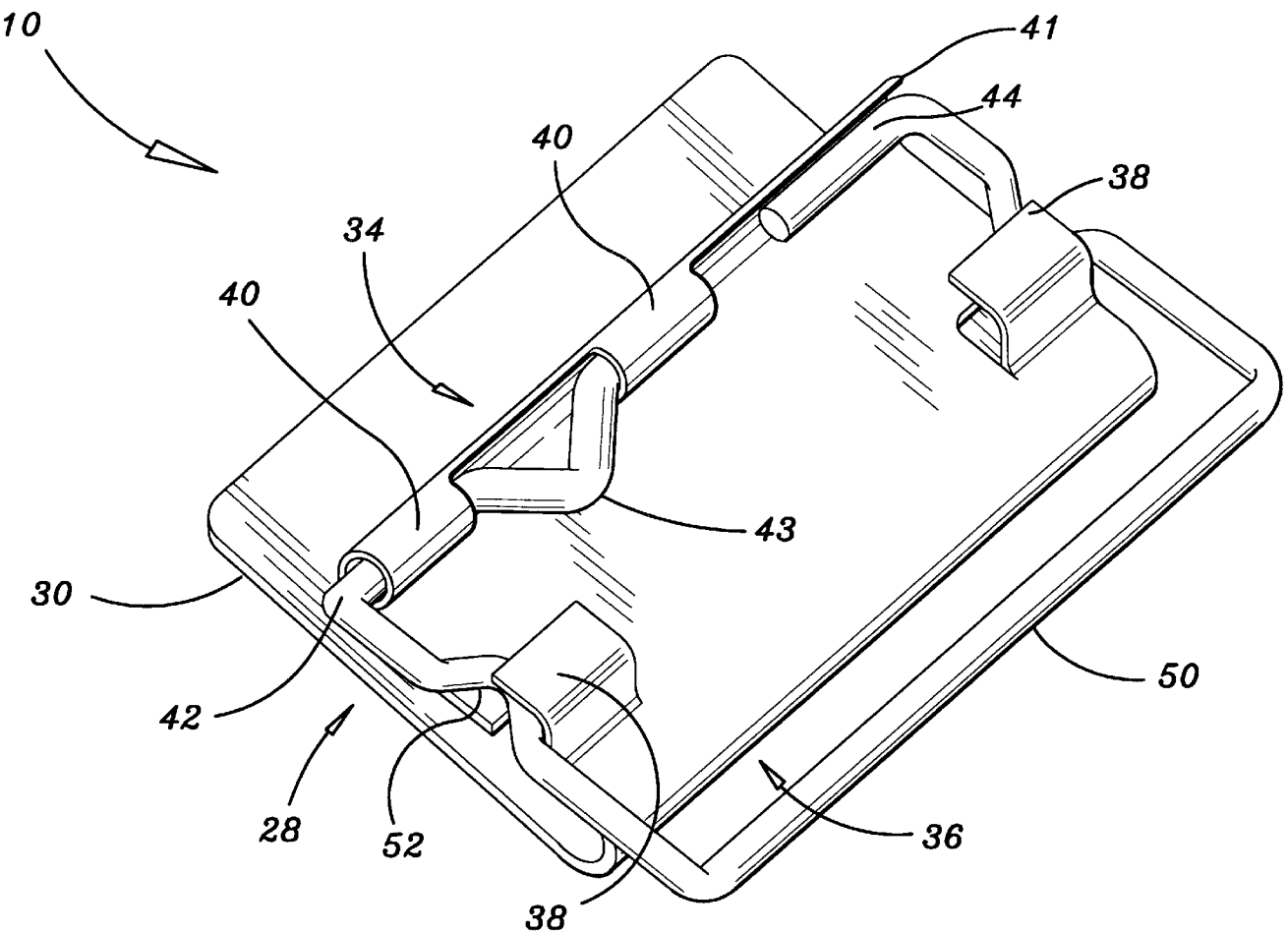

FIGS. 7A, 7B and 7C illustrate an alternative, second embodiment of the binder spacer 10. In this embodiment, the spacing means and the clipping means are separate pieces. The clipping means comprises a U-shaped base 28 having a first panel 30, a second panel 32, an open end 34 and a closed end 36. The U-shaped base 28 is removably attached to the distal edge of a cover 74 of a looseleaf notebook 70. When the binder clip 10 is clipped to a cover 74, the first panel 30 is substantially flush with the exterior surface of the cover 74 and the second panel 32 is substantially flush with the interior surface of the cover 74.

The second panel 32 has a plurality of integral catches 38 cut out of the second panel 32, one of which is used for connecting the second panel 32 to a pin of the spacing means described below. The catches 38 are shaped as an inverted-L and point in the direction towards the open end 34. The second panel 32 also defines a plurality of loops 40 located at the open end 34 used for connecting the U-shaped base 28 to the remaining pin of the spacing means described below. The second panel 32 preferably has a lip 41 adjacent loops 40 which is curled in the direction towards closed end 36.

The spacing means of the alternative embodiment comprises a broken loop beginning with a first pin 42, a first arm 46 connected to the first pin 42, a bridge 50 having two ends, one end of which is connected to the first arm 46, a second arm 48 connected to the other end of the bridge 50, and a second pin 44 connected to the second arm 48 and diametrically positioned opposite the first pin 42. The spacing means is preferably unitary and made of a pliable material, such as wire.

The first arm 46 is rotatably inserted within the loops 40. The first pin 42 has a bend 43 in the area that the first pin 42 is flush against the lip 41 to prevent over-rotation of the spacing means from a perpendicular orientation relative to the second panel 32. The second pin 44 demountably rests against one of said catches 38 or the lip 41.

FIGS. 7B and 7C illustrates the spacing means in its use mode and its storage mode, respectively. In the use mode the spacing means is substantially perpendicular with the clipping means. The second pin 44 rests against one of the catches 38. When viewing the binder spacer 10 from its side, the spacing means appears to be in the shape of an inverted-V.

In the storage mode, the spacing means lies flush against the second panel 32 of the clip. The second pin 44 rests against the lip 41. Both the first arm 46 and the second arm 48 have a indention 52 that removably latches to one of the catches 38.

Figure 8:
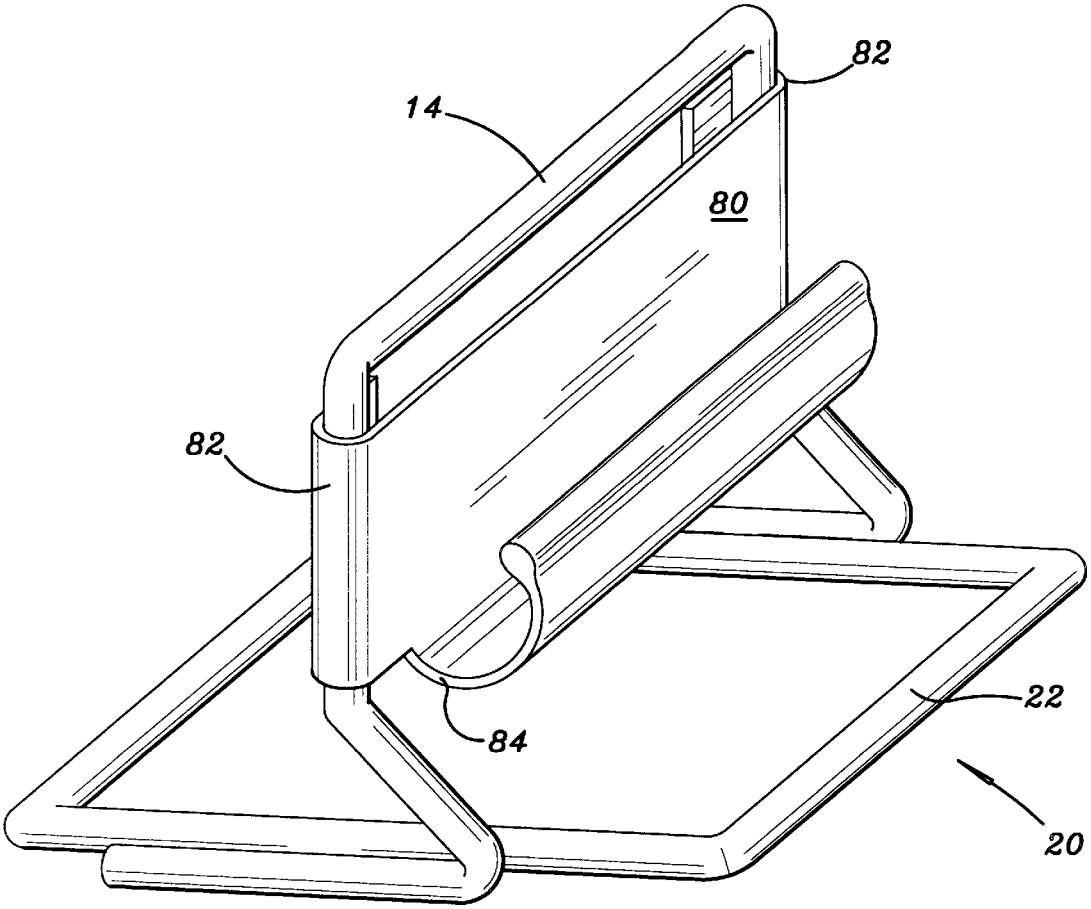
FIG. 8 is an environmental perspective front view of the binder spacer with a removable pen clip attached to the spacing means.
Figure 9:
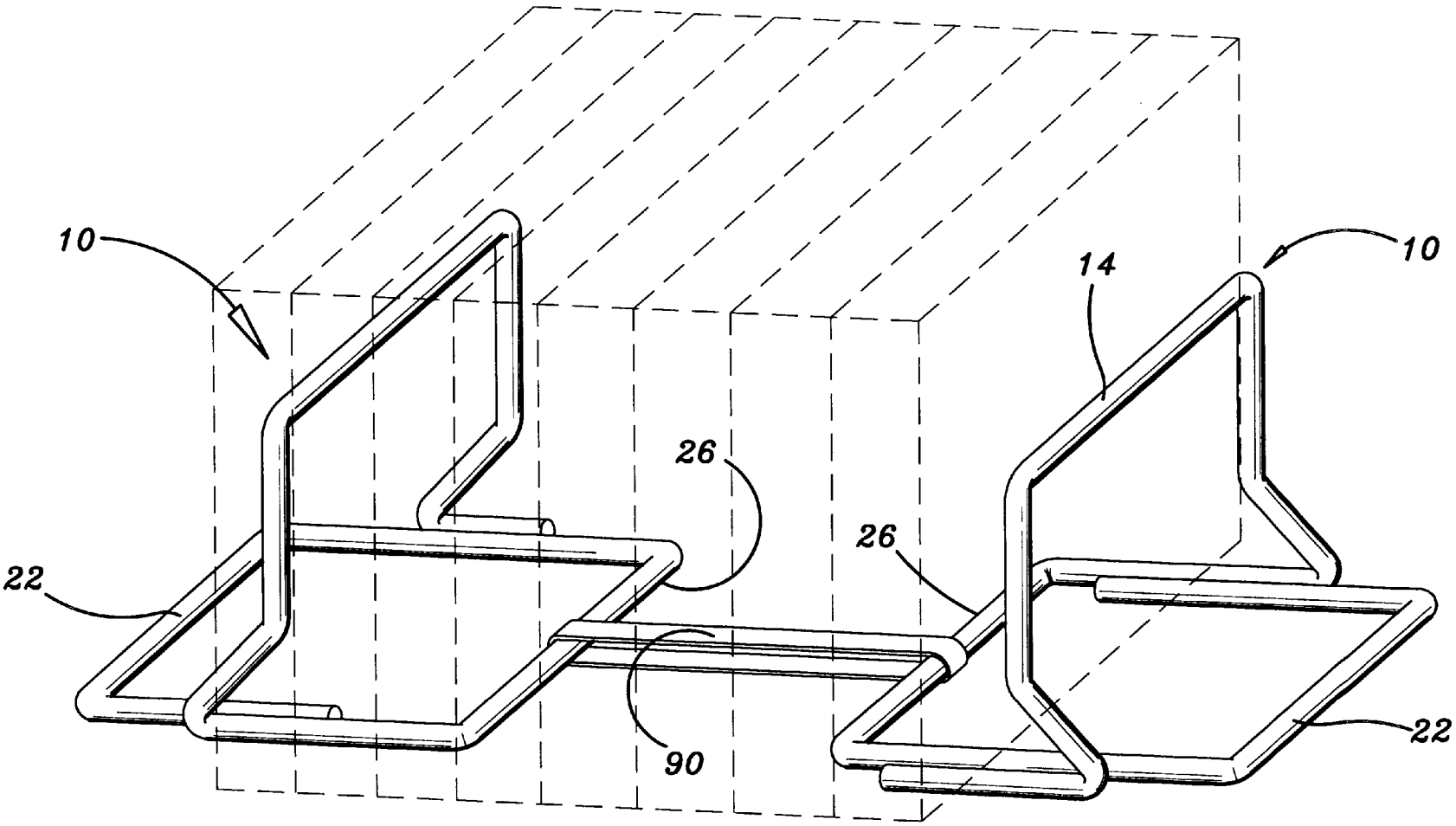
FIG. 9 is an environmental perspective side view of two binder spacers linked together via an elastic band and holding loose items, such as compact disc cases.
Figure 10:
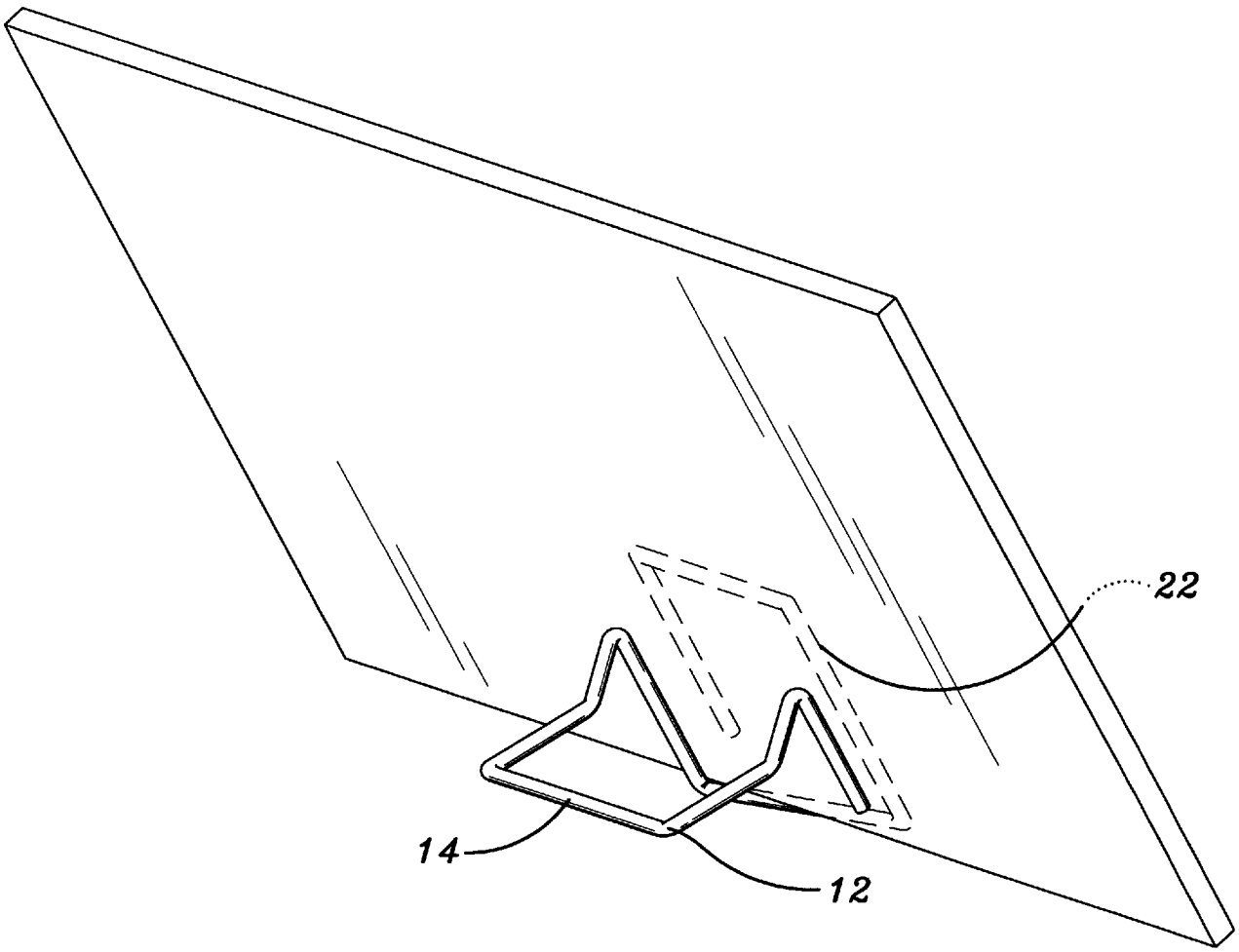
FIG. 10 is an environmental rear view of a binder spacer holding up a placard.

FIGS. 8–10 show the first embodiment of the binder spacer 10 in various uses. In FIG. 8, a pen clip 80 is demountably attached to the legs 12 of the spacer. The pen clip 80 is a rigid sheet material, such as plastic, having a body dimensioned and configured to closely seat onto the legs 12, which body as shown in combination with the preferred embodiment includes a pair of terminal return bends 82, each defining a friction fitting open loop which slides onto an opposite leg 12. A writing pen (not shown) is retained by an open loop closely conformed to the standard circumference of most pens and formed by an normal bend 84 defined in the body at right angles to the return bends 82. The pen clip 80 as described and shown thus embodies and is exemplary of only one of a variety of pen clips 80 which may be adapted as an accessory to the preferred embodiment of the present invention.

FIG. 9 illustrates a pair of binder spacers 10 used in a bookend-like manner to hold a plurality of books, compact discs, etc. A rubber band 90 is placed around each respective rear member 26 of the binder spacers 10 in order to tautly hold the books or compact disks together. FIG. 10 illustrates an inverted binder spacer 10 used as a placard holder, by inserting the placard into the clipping means and orienting the clipping means vertically such that the span 14 and legs 12 serve as a support.

Figure 1:
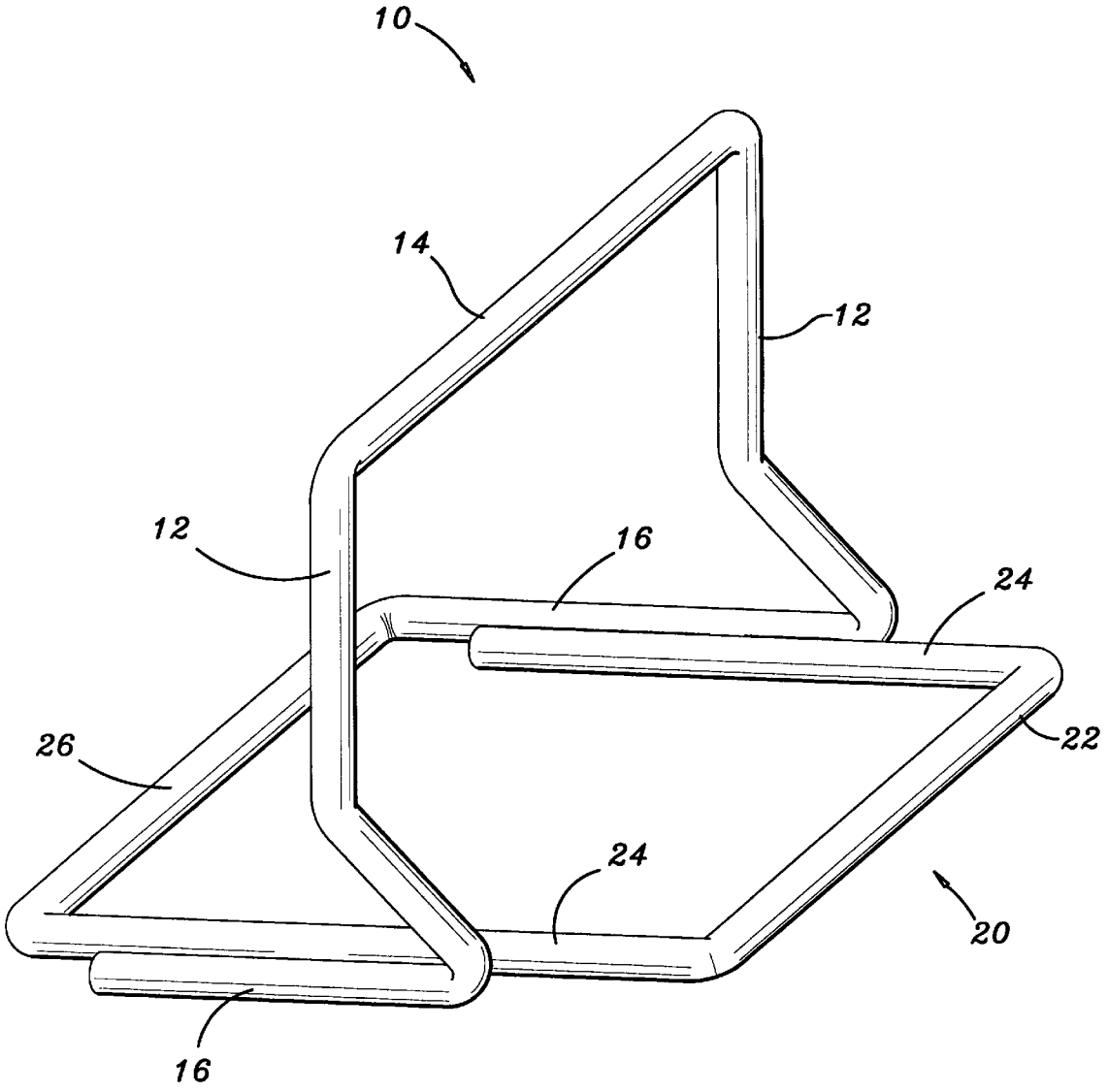
FIG. 1 is a perspective side view of a first embodiment of the looseleaf binder spacer.
Figure 2:
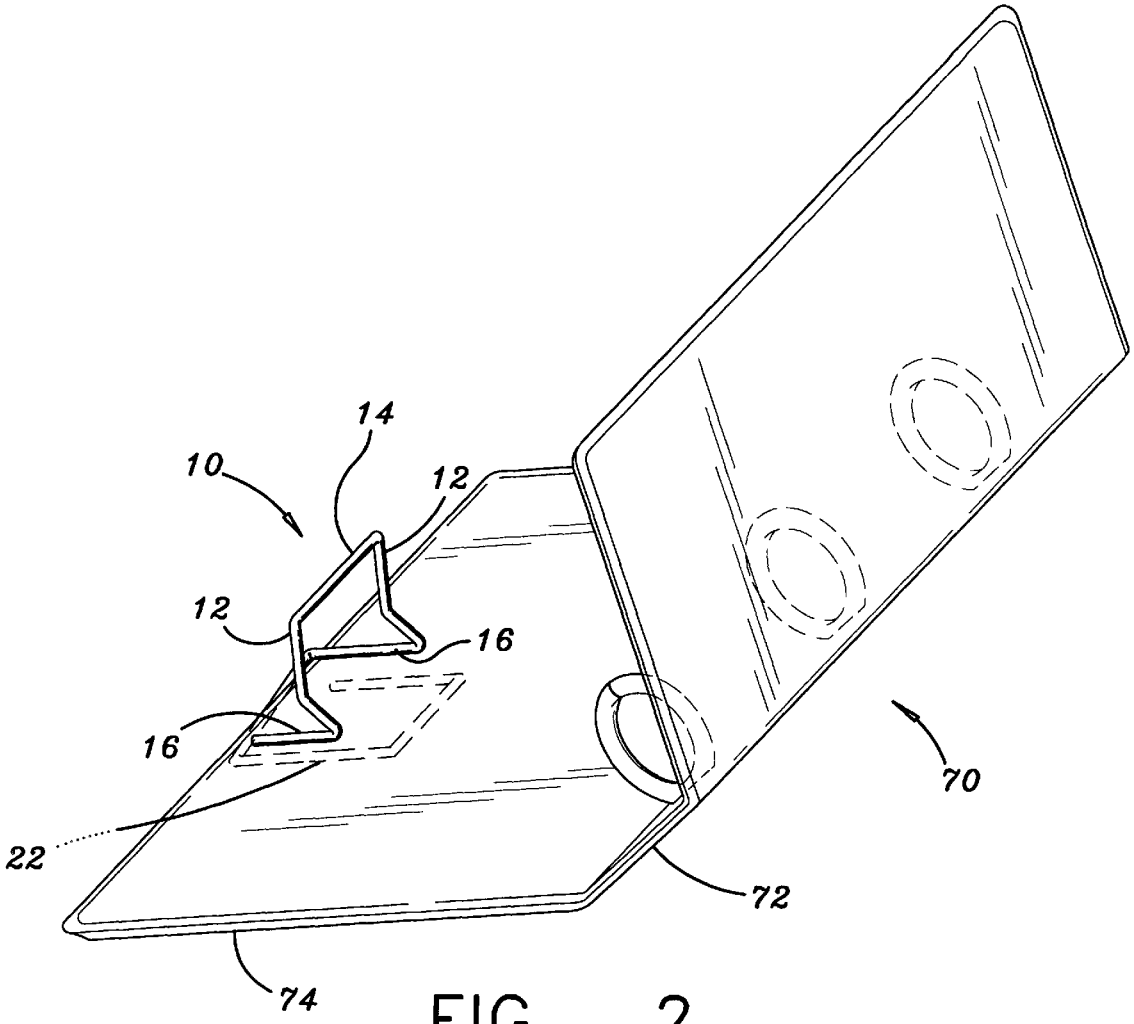
FIG. 2 is an environmental perspective view of the binder spacer clipped to a cover of a looseleaf notebook.
Figure 11:
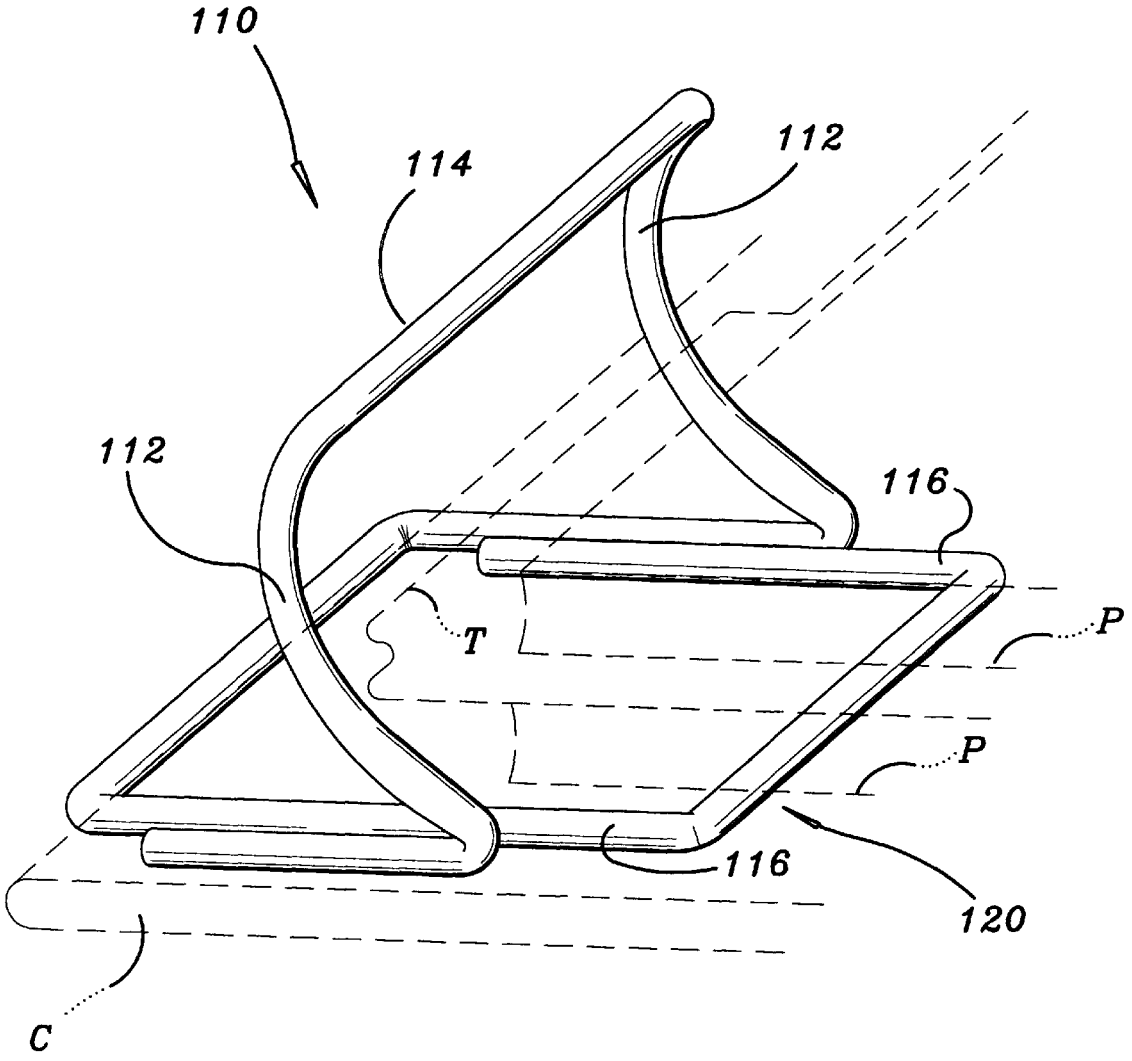
FIG. 11 is a perspective view of a third embodiment of the binder spacer with environmental features shown in broken lines.
Figure 12:
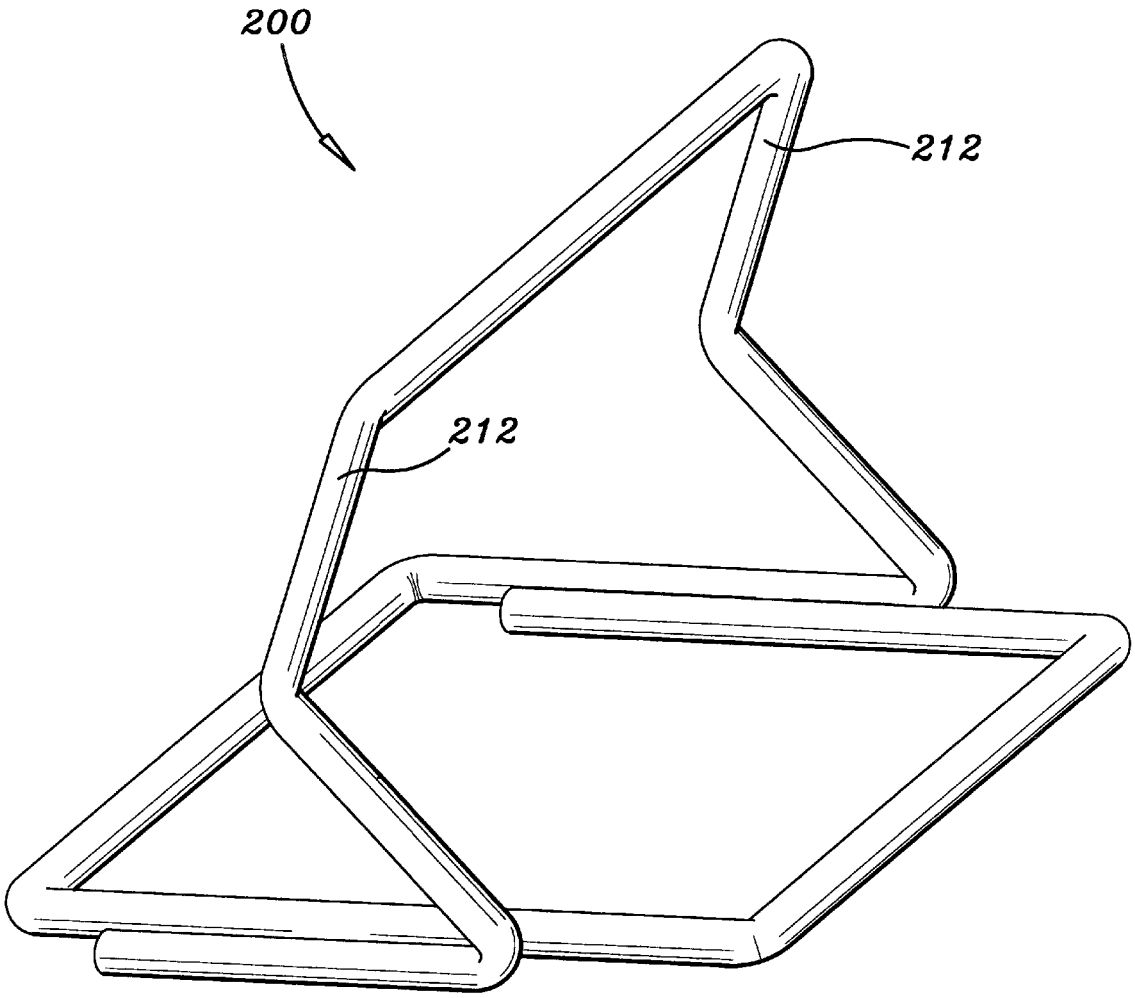
FIG. 12 is a perspective view of a fourth embodiment of the binder spacer.

Turning now to the final embodiments of the present invention, FIG. 11 and FIG. 12 show third and fourth embodiments which incorporate all of the previous functional features of the preferred embodiment as described in reference to the binder spacer 10 shown in FIG. 1, but in which the spacing means is structurally modified to accommodate oversized pages which may protrude along a leading edge of stacked looseleaf binder pages. For example, as shown in FIG. 11, a standard divider page having a tab T is shown separating a stack of looseleaf pages P. The binder spacer 110 is shown having a pair of greatly arced legs 112 supporting a span member 114, wherein the clipping means, including feet 116 of tongue 120, are firmly attached to the rigid cover C in the manner described above. Typically, as a result of the close proximity of the stack of pages P to the edge of the cover C, the oversized divider page and tab T nearly extend to the edge of the cover C. Thus, placement of the binder spacer 10 may interfere with an oversized page. Thus, the arced legs 112 of binder spacer 110 forms a space under the span into which the tab T may extend without interference by a leg 112. In FIG. 12, the legs 212 of the spacing means of the fourth embodiment 200 are similarly configured, wherein the legs 212 are angularly bent, forming a V-shape and thereby similarly permitting the tab to remain free of interference with a leg 212.

It is to be understood that the present invention is not limited to the sole embodiment described above, but encompasses any and all embodiments within the scope of the following claims.

I claim:

1. A binder spacer for use with a looseleaf binder having a spine, and a first and second cover swingably attached to said spine, said looseleaf binder spacer comprising:

a clipping means for clipping to a distal edge of the first cover of the looseleaf notebook, said clipping means comprises:

a pair of feet connected to a distal end of each of said legs, a tongue having a leading edge member and a pair of sides, each of said sides lying substantially flush with each of said feet, a rear member connected to an end of one of said feet and to an end of one of said sides of said tongue, and wherein said feet, said tongue and said rear member are unitary and made of a pliable material; and a spacing means connected to said clipping means for spacing the first cover in a substantially parallel orientation to the second cover, said spacing means being substantially perpendicular to said clipping means and comprises:

a pair of legs having opposing ends, a span connected to one end of each of said legs;

wherein said clipping means and said spacing means are unitary.

2. The binder spacer according to claim 1, wherein said legs have a bend near said clipping means, and wherein said legs straighten out to be substantially perpendicular to said clipping means.

3. A binder spacer for use with a looseleaf binder having a spine, and a first and second cover swingably attached to said spine, said looseleaf binder spacer comprising:

a clipping means for clipping to a distal edge of the first cover of the looseleaf notebook, wherein the clipping means comprises:

an elongated U-shaped base comprising a first and second opposed panels, an open end and a closed end, wherein when said clipping means is removably attaching to a cover of a looseleaf notebook, said first panel is flush with the exterior surface of the cover and said second panel is flush with the interior surface of the cover; and a mating means integral with said second panel for connecting said second panel to said spacing means; and a spacing means connected to said clipping means for spacing the first cover in a substantially parallel orientation to the second cover, said spacing means being substantially perpendicular to said clipping means.

4. The binder spacer according to claim 3, wherein said mating means comprises:

a plurality of catches cut out of said second panel and located near said closed end; and a plurality of loops located at said open end of said second panel.

5. The binder spacer according to claim 4, wherein said spacing means comprises:

a first pin rotatably inserted in said loops;

a second pin demountably rested against one of said catches;

a first arm connected to said first pin;

a second arm connected to said second pin;

a bridge having a first end connected to said first arm and a second end connected said second arm; and wherein said first pin, said first arm, said bridge, said second arm and said second pin are unitary.

* * * * *